US010029342B2

(12) United States Patent
Xue et al.

(10) Patent No.: US 10,029,342 B2
(45) Date of Patent: Jul. 24, 2018

(54) INNER-SUPPORTING-TYPE ONLINE ROUNDNESS CORRECTING DEVICE FOR SEMIFINISHED WHEEL

(71) Applicant: CITIC Dicastal CO., LTD, Qinhuangdao (CN)

(72) Inventors: Bowen Xue, Qinhuangdao (CN); Jiandong Guo, Qinhuangdao (CN)

(73) Assignee: CITIC Dicastal CO., LTD, Qinhuangdao (CN)

( * ) Notice: Subject to any disclaimer, the term of this patent is extended or adjusted under 35 U.S.C. 154(b) by 28 days.

(21) Appl. No.: 15/392,570

(22) Filed: Dec. 28, 2016

(65) Prior Publication Data

US 2017/0182618 A1 Jun. 29, 2017

(30) Foreign Application Priority Data

Dec. 29, 2015 (CN) ..... 2015 1 1006527

(51) Int. Cl.
*B24B 9/04* (2006.01)
*B21H 1/10* (2006.01)

(52) U.S. Cl.
CPC ..... *B24B 9/04* (2013.01)

(58) Field of Classification Search
CPC ..... B24B 9/04; B21H 1/10
USPC ..... 451/294, 49, 51, 5; 72/110; 157/2
See application file for complete search history.

(56) References Cited

U.S. PATENT DOCUMENTS 422,689 A * 3/1890 Armstrong ..... B60C 25/147 157/1
604,654 A * 5/1898 Clawson ..... B60B 31/005 157/1.36
1,955,358 A * 4/1934 Connor ..... B21D 53/32 33/203.16
3,000,426 A * 9/1961 Ducker ..... B21H 1/02 72/110
9,833,873 B2 * 12/2017 Xue ..... B24B 29/005

* cited by examiner

*Primary Examiner* — Robert Rose
(74) *Attorney, Agent, or Firm* — Jeremy Howard

(57) ABSTRACT

The present invention provides an improved inner-supporting-type online roundness correcting device for a semifinished wheel, which comprises a machine frame, hydraulic cylinders, guide rails, servo motors and correcting wheels. When a bulge of the wheel is met, angles of left correcting wheels II are adjusted through a left servo motor, the left correcting wheels II are kept to be in contact with an inner rim of the wheel all the time and remain stationary in the position, and then, a left hydraulic cylinder enables a left correcting wheel Ito press the bulge of the wheel, so as to recover the roundness of the bulge; and when a depression of the wheel is met, right correcting wheels I are kept to be in contact with an outer rim of the wheel all the time and remain stationary in the position through a right hydraulic cylinder, the angle of a right correcting wheel II is adjusted through a right servo motor, and compressing hydraulic cylinders enable the right correcting wheel II to press the depression of the wheel, so as to recover the roundness of the depression.

2 Claims, 3 Drawing Sheets

INNER-SUPPORTING-TYPE ONLINE ROUNDNESS CORRECTING DEVICE FOR SEMIFINISHED WHEEL

This application claims priority from CN 201511006527.6, filed on Dec. 29, 2015, the entire content of which is incorporated herein by reference.

TECHNICAL FIELD

The present invention relates to a roundness correcting device, in particular to an improved inner-supporting-type online roundness correcting device for a semifinished wheel.

BACKGROUND ART

During the heat treatment of an aluminum alloy wheel, the roundness of rims will result in certain deformation due to influence caused by some factors, and the condition that some positions may not be processed during subsequent machining may be caused if correcting recovery is not carried out. At present, a roundness repairing method comprises the steps of holding a roundness gage by workers with hands to find deformations, then, internally supporting the deformations forcefully with hydraulic cylinders, and carrying out approximate repair by virtue of experience, and this method has a little effect (not obvious) on wheels with roundness depressions and is not effective at all to wheels with roundness bulges. At the same time, this method is low in efficiency and high in labor intensity, and the repair effect is far from ideal requirements.

SUMMARY OF THE INVENTION

An object of the present invention is to provide an improved inner-supporting-type online roundness correcting device for a semifinished wheel, an online roundness correcting function for the semifinished wheel can be achieved, and the corrected wheel has good roundness and cylindricity.

To achieve the object described above, a technical solution of the present invention is as follows: an improved inner-supporting-type online roundness correcting device for a semifinished wheel comprises a machine frame, a bottom plate, gears, gear racks, lower guide rails, a left sliding plate, lower bearing blocks, shafts, V-type rollers, an upper bearing block, a sliding column, a left platform, a left guide rail, a left hydraulic cylinder, a left sliding block, a left correcting wheel I, left correcting wheels II, a left support bar, a sliding sleeve, a spring, a rising and falling plate, compressing hydraulic cylinders, guide sleeves, guide posts, a limiting screw, a right support bar, a right correcting wheel II, right correcting wheels I, a right sliding block, a right hydraulic cylinder, a right guide rail, a right platform, a right sliding plate, a synchronizing hydraulic cylinder, a lower servo motor, a left servo motor and a right servo motor, both the left sliding plate and the right sliding plate are mounted above the bottom plate through the lower guide rails; the two gears are also mounted above the bottom plate, and the four gear racks engaged with the two gears are separately fixed under the left sliding plate and the right sliding plate; the four lower bearing blocks are separately fixed on the left sliding plate and the right sliding plate in a grouped manner; the shafts, of which upper ends are separately provided with the four V-type rollers, are mounted inside the four lower bearing blocks through bearings; the lower servo motor is fixed at the lower end of the right sliding plate, and an output end of the lower servo motor is connected with the lower end of one shaft; and the synchronizing hydraulic cylinder is fixed at the right side of the machine frame, and an output end of the synchronizing hydraulic cylinder is connected with the right sliding plate.

The left sliding block is mounted above the left platform through the left guide rail; and the left correcting wheel I is mounted at the right side of the left sliding block, the left hydraulic cylinder is fixed at the left side of the machine frame, and an output end of the left hydraulic cylinder is connected with the left sliding block.

The right sliding block is mounted above the right platform through the right guide rail; and the right correcting wheels I are mounted at the left side of the right sliding block, the right hydraulic cylinder is fixed at the right side of the machine frame, and an output end of the right hydraulic cylinder is connected with the right sliding block.

The upper bearing block is mounted at the lower end of the sliding column through a bearing; the upper end of the sliding column is in fit with the internal wall of the sliding sleeve, and the sliding column is limited by the limiting screw; the spring is mounted inside the sliding sleeve and is arranged at the top end of the sliding column; the sliding sleeve is fixed under the rising and falling plate; the left servo motor and the right servo motor are separately fixed at the two sides of the sliding sleeve and are arranged at the lower end of the rising and falling plate; output ends of the left servo motor and the right servo motor are separately connected with the left support bar and the right support bar; the left correcting wheels II are mounted at the tail end of the left support bar, and the right correcting wheel II is mounted at the tail end of the right support bar; the two compressing hydraulic cylinders are mounted at the top end of the machine frame, and output ends of the two compressing hydraulic cylinders are hinged to the top end of the rising and falling plate; and the four guide sleeves are also fixed at the top end of the machine frame, and the four guide posts matched with the four guide sleeves are fixed at the top end of the rising and falling plate.

During actual use, the wheel is initially fixed on a roller way in a manner that the front surface faces down, the synchronizing hydraulic cylinder enables the four V-type rollers to clamp the wheel through the gears and the gear racks, and the lower servo motor enables the wheel to rotate in a clamped state; the compressing hydraulic cylinders enable the sliding column to press the wheel through the guide posts, a guiding post at the front end of the sliding column is in fit with a center hole of the wheel, and the lower end of the upper bearing block is in fit with a flange face of the wheel; when a bulge of the wheel is met, angles of the left correcting wheels II are adjusted through the left servo motor, the left correcting wheels II are kept to be in contact with an inner rim of the wheel all the time and remain stationary in the position, and then, the left hydraulic cylinder enables the left correcting wheel I to press the bulge of the wheel, so as to recover the roundness of the bulge; and when a depression of the wheel is met, the right correcting wheels I are kept to be in contact with an outer rim of the wheel all the time and remain stationary in the position through the right hydraulic cylinder, the angle of the right correcting wheel II is adjusted through the right servo motor, and the compressing hydraulic cylinders enable the right correcting wheel II to press the depression of the wheel, so as to recover the roundness of the depression.

According to the improved inner-supporting-type online roundness correcting device provided by the present invention, in service, the online roundness correcting function for the semifinished wheel can be achieved, and the corrected wheel has good roundness and cylindricity, so that not only can the labor intensity for workers be lowered, but also the improved inner-supporting-type online roundness correcting device has the characteristics of high degree of automation, advanced process, simple structure and safe and stable performance.

Figure 1:
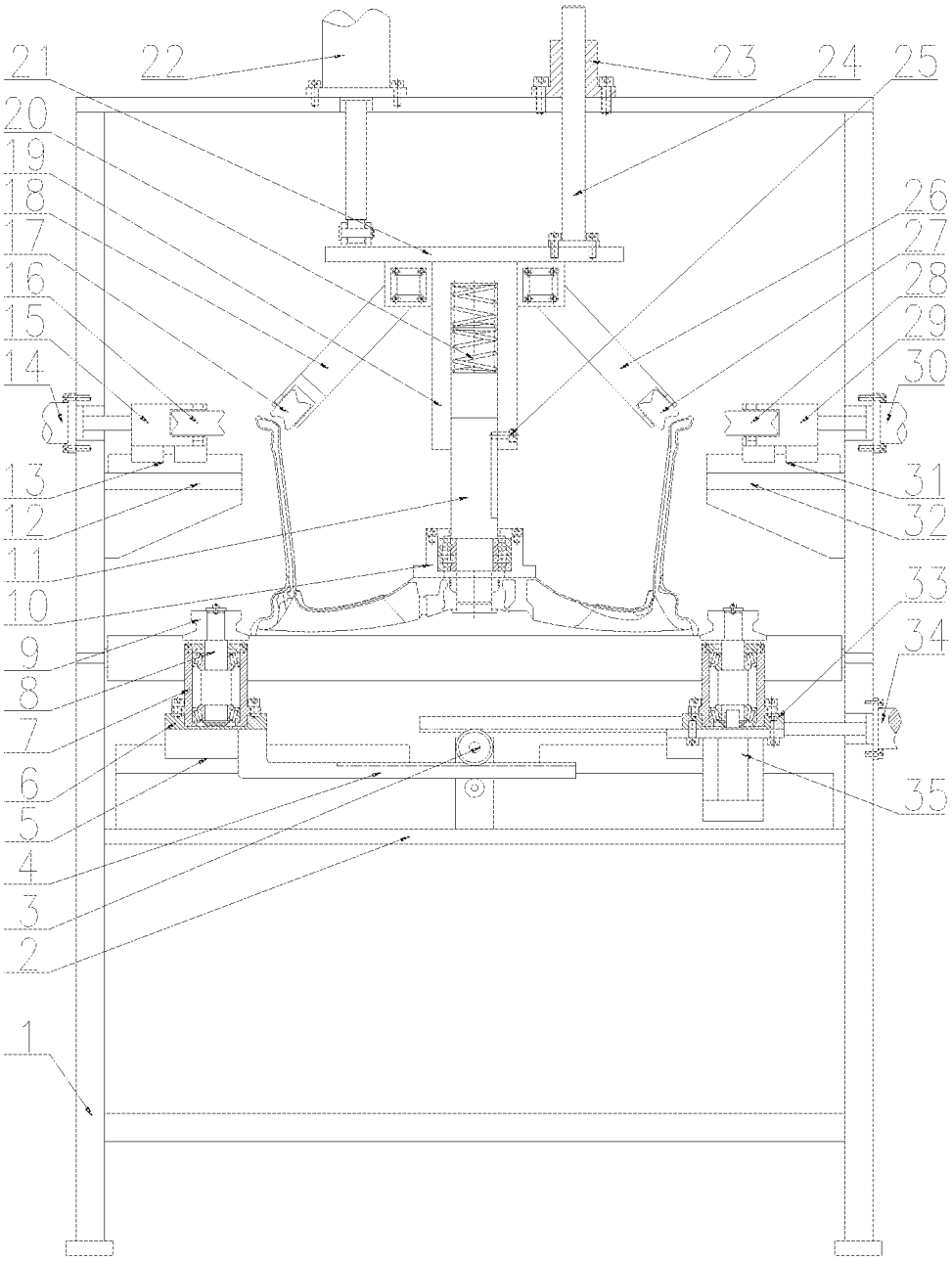
FIG. 1 is a front view of an improved inner-supporting-type online roundness correcting device for a semifinished wheel.
Figure 2:
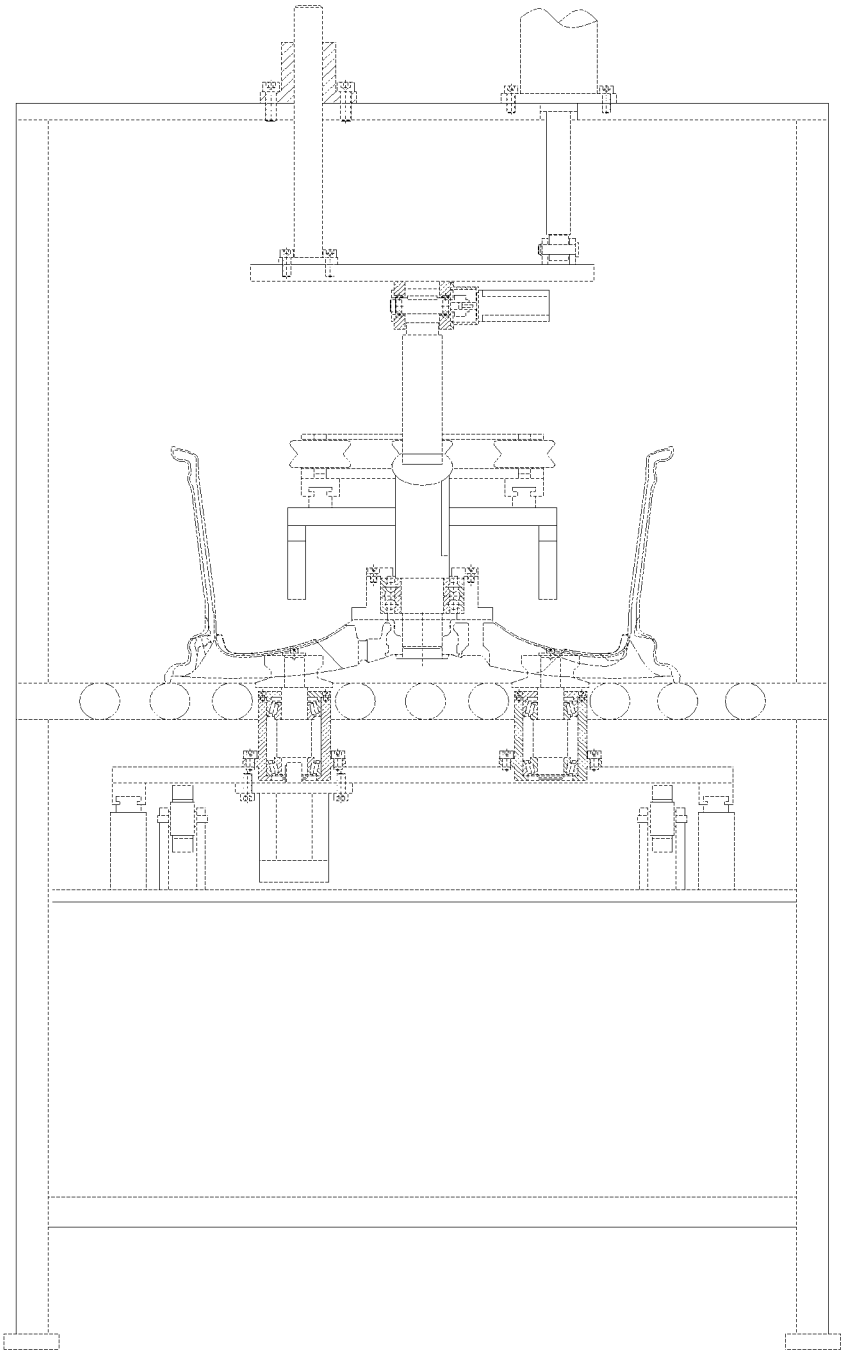
FIG. 2 is a left view of an improved inner-supporting-type online roundness correcting device for a semifinished wheel.
Figure 3:
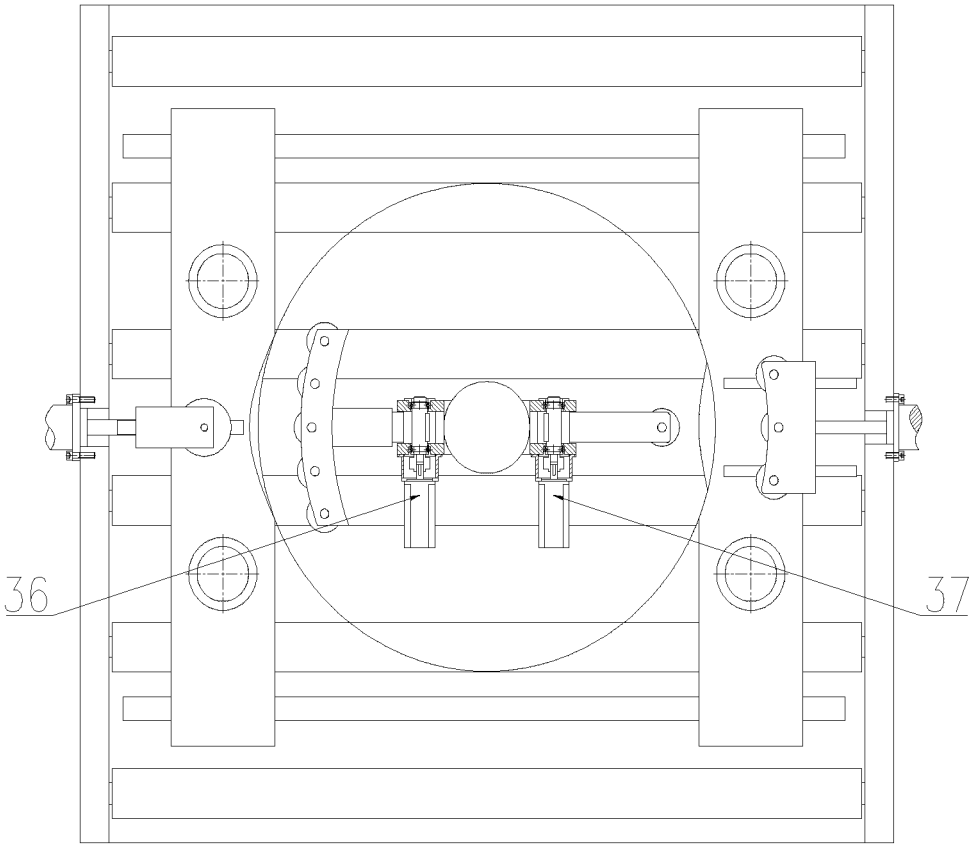
FIG. 3 is a local top view of an improved inner-supporting-type online roundness correcting device for a semifinished wheel.

1-machine frame,
2-bottom plate,
3-gear,
4-gear rack,
5-lower guide rail,
6-left sliding plate,
7-lower bearing block,
8-shaft,
9-V-type roller,
10-upper bearing block,
11-sliding column,
12-left platform,
13-left guide rail,
14-left hydraulic cylinder, 15-left sliding block, 16-left correcting wheel I, 17-left correcting wheel II, 18-left support bar, 19-sliding sleeve,
20-spring,
21-rising and falling plate,
22-compressing hydraulic cylinder,
23-guide sleeve,
24-guide post,
25-limiting screw,
26-right support bar,
27-right correcting wheel II,
28-right correcting wheel I,
29-right sliding block,
30-right hydraulic cylinder,
31-right guide rail,
32-right platform,
33-right sliding plate,
34-synchronizing hydraulic cylinder,
35-lower servo motor,
36-left servo motor, and
37-right servo motor.

DETAILED DESCRIPTION OF THE INVENTION

In the following, the details and working conditions of a specific device provided by the present invention are described in combination with figures.

An improved inner-supporting-type online roundness correcting device for a semifinished wheel comprises a machine frame 1, a bottom plate 2, gears 3, gear racks 4, lower guide rails 5, a left sliding plate 6, lower bearing blocks 7, shafts 8, V-type rollers 9, an upper bearing block 10, a sliding column 11, a left platform 12, a left guide rail 13, a left hydraulic cylinder 14, a left sliding block 15, a left correcting wheel I 16, left correcting wheels II 17, a left support bar 18, a sliding sleeve 19, a spring 20, a rising and falling plate 21, compressing hydraulic cylinders 22, guide sleeves 23, guide posts 24, a limiting screw 25, a right support bar 26, a right correcting wheel II 27, right correcting wheels I 28, a right sliding block 29, a right hydraulic cylinder 30, a right guide rail 31, a right platform 32, a right sliding plate 33, a synchronizing hydraulic cylinder 34, a lower servo motor 35, a left servo motor 36 and a right servo motor 37, both the left sliding plate 6 and the right sliding plate 33 are mounted above the bottom plate 2 through the lower guide rails 5; the two gears 3 are also mounted above the bottom plate 2, and the four gear racks 4 engaged with the two gears 3 are separately fixed under the left sliding plate 6 and the right sliding plate 33; the four lower bearing blocks 7 are separately fixed on the left sliding plate 6 and the right sliding plate 33 in a grouped manner; the shafts 8, of which upper ends are separately provided with the four V-type rollers 9, are mounted inside the four lower bearing blocks 7 through bearings; the lower servo motor 35 is fixed at the lower end of the right sliding plate 33, and an output end of the lower servo motor 35 is connected with the lower end of one shaft 8; and the synchronizing hydraulic cylinder 34 is fixed at the right side of the machine frame 1, and an output end of the synchronizing hydraulic cylinder 34 is connected with the right sliding plate 33.

The left sliding block 15 is mounted above the left platform 12 through the left guide rail 13; and the left correcting wheel I 16 is mounted at the right side of the left sliding block 15, the left hydraulic cylinder 14 is fixed at the left side of the machine frame 1, and an output end of the left hydraulic cylinder 14 is connected with the left sliding block 15.

The right sliding block 29 is mounted above the right platform 32 through the right guide rail 31; and the right correcting wheels I 28 are mounted at the left side of the right sliding block 29, the right hydraulic cylinder 30 is fixed at the right side of the machine frame 1, and an output end of the right hydraulic cylinder 30 is connected with the right sliding block 29.

The upper bearing block 10 is mounted at the lower end of the sliding column 11 through a bearing; the upper end of the sliding column 11 is in fit with the internal wall of the sliding sleeve 19, and the sliding column 11 is limited by the limiting screw 25; the spring 20 is mounted inside the sliding sleeve 19 and is arranged at the top end of the sliding column 11; the sliding sleeve 19 is fixed under the rising and falling plate 21; the left servo motor 36 and the right servo motor 37 are separately fixed at the two sides of the sliding sleeve 19 and are arranged at the lower end of the rising and falling plate 21; output ends of the left servo motor 36 and the right servo motor 37 are separately connected with the left support bar 18 and the right support bar 26; the left correcting wheels II 17 are mounted at the tail end of the left support bar 18, and the right correcting wheel II 27 is mounted at the tail end of the right support bar 26; the two compressing hydraulic cylinders 22 are mounted at the top end of the machine frame 1, and output ends of the two compressing hydraulic cylinders 22 are hinged to the top end of the rising and falling plate 21; and the four guide sleeves 23 are also fixed at the top end of the machine frame 1, and the four guide posts 24 matched with the four guide sleeves 23 are fixed at the top end of the rising and falling plate 21.

During work, the wheel is initially fixed on a roller way in a manner that the front surface faces down, the synchronizing hydraulic cylinder 34 enables the four V-type rollers 9 to clamp the wheel through the gears 3 and the gear racks 4, and the lower servo motor 35 enables the wheel to rotate in a clamped state; the compressing hydraulic cylinders 22 enable the sliding column 11 to press the wheel through the guide posts 24, a guiding post at the front end of the sliding column 11 is in fit with a center hole of the wheel, and the lower end of the upper bearing block 10 is in fit with a flange face of the wheel; when a bulge of the wheel is met, angles of the left correcting wheels II 17 are adjusted through the left servo motor 36, the left correcting wheels II 17 are kept to be in contact with an inner rim of the wheel all the time and remain stationary in the position, and then, the left hydraulic cylinder 14 enables the left correcting wheel I 16 to press the bulge of the wheel, so as to recover the roundness of the bulge; and when a depression of the wheel is met, the right correcting wheels I 28 are kept to be in contact with an outer rim of the wheel all the time and remain stationary in the position through the right hydraulic cylinder 30, the angle of the right correcting wheel II 27 is adjusted through the right servo motor 37, and the compressing hydraulic cylinders 22 enable the right correcting wheel II 27 to press the depression of the wheel, so as to recover the roundness of the depression.

What is claimed is:

1. An improved inner-supporting-type online roundness correcting device for a semifinished wheel, which comprises a machine frame (1), a bottom plate (2), gears (3), gear racks (4), lower guide rails (5), a left sliding plate (6), lower bearing blocks (7), shafts (8), V-type rollers (9), an upper bearing block (10), a sliding column (11), a left platform (12), a left guide rail (13), a left hydraulic cylinder (14), a left sliding block (15), a left correcting wheel I (16), left correcting wheels II (17), a left support bar (18), a sliding sleeve (19), a spring (20), a rising and falling plate (21), compressing hydraulic cylinders (22), guide sleeves (23), guide posts (24), a limiting screw (25), a right support bar (26), a right correcting wheel II (27), right correcting wheels I (28), a right sliding block (29), a right hydraulic cylinder (30), a right guide rail (31), a right platform (32), a right sliding plate (33), a synchronizing hydraulic cylinder (34), a lower servo motor (35), a left servo motor (36) and a right servo motor (37);

characterized in that both the left sliding plate (6) and the right sliding plate (33) are mounted above the bottom plate (2) through the lower guide rails (5); the two gears (3) are also mounted above the bottom plate (2), and the four gear racks (4) engaged with the two gears (3) are separately fixed under the left sliding plate (6) and the right sliding plate (33); the four lower bearing blocks (7) are separately fixed on the left sliding plate (6) and the right sliding plate (33) in a grouped manner; the shafts (8), of which upper ends are separately provided with the four V-type rollers (9), are mounted inside the four lower bearing blocks (7) through bearings; the lower servo motor (35) is fixed at the lower end of the right sliding plate (33), and an output end of the lower servo motor (35) is connected with the lower end of one shaft (8); the synchronizing hydraulic cylinder (34) is fixed at the right side of the machine frame (1), and an output end of the synchronizing hydraulic cylinder (34) is connected with the right sliding plate (33);

the left sliding block (15) is mounted above the left platform (12) through the left guide rail (13); the left correcting wheel I (16) is mounted at the right side of the left sliding block (15), the left hydraulic cylinder (14) is fixed at the left side of the machine frame (1), and an output end of the left hydraulic cylinder (14) is connected with the left sliding block (15);

the right sliding block (29) is mounted above the right platform (32) through the right guide rail (31); the right correcting wheels I (28) are mounted at the left side of the right sliding block (29), the right hydraulic cylinder (30) is fixed at the right side of the machine frame (1), and an output end of the right hydraulic cylinder (30) is connected with the right sliding block (29);

the upper bearing block (10) is mounted at the lower end of the sliding column (11) through a bearing; the upper end of the sliding column (11) is in fit with the internal wall of the sliding sleeve (19), and the sliding column (11) is limited by the limiting screw (25); the spring (20) is mounted inside the sliding sleeve (19) and is arranged at the top end of the sliding column (11); the sliding sleeve (19) is fixed under the rising and falling plate (21); the left servo motor (36) and the right servo motor (37) are separately fixed at the two sides of the sliding sleeve (19) and are arranged at the lower end of the rising and falling plate (21); output ends of the left servo motor (36) and the right servo motor (37) are separately connected with the left support bar (18) and the right support bar (26); the left correcting wheels II (17) are mounted at the tail end of the left support bar (18), and the right correcting wheel II (27) is mounted at the tail end of the right support bar (26); the two compressing hydraulic cylinders (22) are mounted at the top end of the machine frame (1), and output ends of the two compressing hydraulic cylinders (22) are hinged to the top end of the rising and falling plate (21); and the four guide sleeves (23) are also fixed at the top end of the machine frame (1), and the four guide posts (24) matched with the four guide sleeves (23) are fixed at the top end of the rising and falling plate (21).

2. The improved inner-supporting-type online roundness correcting device for the semifinished wheel according to claim 1, characterized in that the number of the left correcting wheels II (17) is 5, and the left correcting wheels II (17) are uniformly distributed and arranged on a circular arc; the number of the right correcting wheels I (28) is 3, and the right correcting wheels I (28) are also uniformly distributed and arranged on a circular arc; and the number of the left correcting wheel I (16) is 1, and the number of the right correcting wheel II (27) is also 1.

* * * * *